United States Patent [19]

Kimura et al.

[11] 4,164,116

[45] Aug. 14, 1979

[54] METHOD OF PRODUCING A POLYESTER FILAMENT YARN HAVING A HIGH LEVEL OF TWIST

[75] Inventors: Akio Kimura, Ibaraki; Osamu Wada, Takatsuki; Michikage Matsui; Kiyotaka Ozaki, both of Ibaraki, all of Japan

[73] Assignee: Teijin Limited, Osaka, Japan

[21] Appl. No.: 879,924

[22] Filed: Feb. 22, 1978

[30] Foreign Application Priority Data

Feb. 25, 1977 [JP] Japan ..... 52-19288

[51] Int. Cl.[2] ..... D02G 3/00

[52] U.S. Cl. ..... 57/282; 57/290

[58] Field of Search ..... 57/157 TS, 157 S, 157 MS, 57/282, 290

[56] References Cited

U.S. PATENT DOCUMENTS

| | | | |
|---|---|---|---|
| 3,886,722 | 6/1975 | Hou et al. | 57/157 TS |
| 3,936,999 | 2/1976 | Ikeda et al. | 57/157 TS |
| 3,977,175 | 8/1976 | Yoshikawa et al. | 57/157 TS |

*Primary Examiner*—Charles Gorenstein

*Attorney, Agent, or Firm*—Sughrue, Rothwell, Mion, Zinn and Macpeak

[57] ABSTRACT

The present invention relates to a method of producing a twisted polyester filament yarn having a high level of twist used for a woven or knitted crepe fabric.

A method of this invention comprises imparting a high level of twist to a polyester filament yarn which has particular properties, and heat setting said twisted polyester filament yarn. The first of these properties which the polyester filament yarn has is that a boil-off shrinkage in boiling water is in the range of 0% to 5%. The second is that a thermal shrinkage stress at 140° C. in hot air is more than 0.03 g/de. The third is that a ratio of a thermal shrinkage stress at 180° C. in hot air to a thermal shrinkage stress at 140° C. is more than 1.0.

The polyester filament yarn which has above mentioned properties can be obtained by repeating heat treatment several times at a temperature from 160° C. to 220° C. in hot air, stretching the polyester filament yarn in a range of 2% to 10% and successively shrinking it in the same range, or by being subjected to heat treatment at a temperature from 160° C. to 220° C. in hot air, shrinking restrictively the polyester filament yarn in a range of 0% to 10% under the relaxed state.

5 Claims, No Drawings

METHOD OF PRODUCING A POLYESTER FILAMENT YARN HAVING A HIGH LEVEL OF TWIST

BACKGROUND OF THE INVENTION

The present invention relates to a method of producing a hard twisted polyester filament yarn, and more particularly, it relates to a method of producing a hard twisted polyester filament yarn suitably used for woven or knitted crepe fabrics, which are usually used for various purposes, such as dress, blouse, shirt, and etc., because of the particular hand and the excellent appearance of them. As used herein a hard twisted yarn is one having a high level of twist.

It is well known in the field of textile industry that crepe fabrics with hard twisted yarns, especially, with hard twisted thermoplastic filament yarns can be made by different methods.

The following process is well known as a typical method:

(a) Making woven or knitted fabrics with hard twisted yarns, a torque of which is temporarily diminished by steam setting (namely, which becomes temporarily latent).

(b) Relaxing these fabrics in hot water, so that the strong torque of the hard twisted yarn comes back in these fabrics, by which crepe is finally developed.

In the above mentioned method, however, the polyester filament yarn produced by the conventional manner is used for crepe fabrics. So it often occurs that crepe can not be satisfactorily developed on fabrics only by soaking fabrics in hot water or by vibrating fabrics soaked in hot water for long time, because the torque of such hard twisted yarn is not sufficiently revived in the process of developing crepe. Moreover, as it is very difficult to set uniformly a torque of hard twisted yarn, the irregularity of setting effects gives rise to non-uniform development of the crepe and the width of the fabric, and still to reduce the shrinkage in the direction of fabric width, which cause the deterioration of hand and crepe quality.

To obviate above mentioned problems, a method is proposed in Japanese Patent Publication No. 23619/1976, wherein a hard twisted yarn is used for crepe fabric, composed of polyethylene terephthalene filaments having a specific gravity above 1.390 which is successively treated by steam at a temperature from 60° C. to 90° C. after passing through a sizing process. In the above described method, it is important to use a hard twisted yarn composed of polyethylene terephthalate filaments which have a specific gravity above 1.390, while in former methods, polyethylene terephthalate filament generally having a specific gravity from 1.384 to 1.388, at most, up to 1.389, is used for manufacturing woven or knitted crepe fabrics.

Further, a method of obtaining such a high specific gravity of polyethylene terephthalate filaments as mentioned above is also disclosed in Japanese Patent Publication No. 23619/1976, in the method of which polyethylene terephthalate filaments produced in the conventional manner, being less than 1.390 in specific gravity, are subjected to the heat treatment in a tense state for a certain time, at a temperature which must be in the range from 180° C. to 220° C., or subjected to another embodied heat treatment, wherein polyethylene terephthalate filaments produced in the conventional manner are passed on a hot plate at a temperature from 190° C. to 220° C. successively after drawing, though the temperature of setting polyethylene terephthalate is usually adopted in the range of 150° C. to 180° C. in the conventional manner. Thus, the resulting polyethylene terephthalate filaments come to have a specific gravity above 1.390.

It can, however, be said that above mentioned method may have such serious problems as a deteriorated dyeing-ability, a harsher hand and a difficult processing due to a high specific gravity. Therefore, it is preferable that a temperature of heat treatment carried out successively after drawing is as low as possible, without such a critical condition as described in Japanese Pat. Publication No. 23619/1976, wherein the specific gravity of polyethylene terephthalate filaments are required to be more than 1.390, obtained only by a higher temperature of heat treatment.

SUMMARY OF THE INVENTION

Accordingly, it is an object of the present invention to provide a method of producing a hard twisted polyester filament yarn, which is capable of making a woven or knitted crepe fabric having uniform, excellent crepe. It is another object of the present invention to provide a method of producing a hard twisted polyester filament yarn, which is capable of making a woven or knitted crepe fabric having a uniform width and a desirable heat shrinkage of fabric.

It is further object of the present invention to provide a method of producing a hard twisted polyester filament yarn, which is capable of making a woven or knitted crepe fabric without serious problems such as a deteriorated dyeing ability, a harsher hand and a difficult processing.

It is a feature of the present invention to provide a method of producing a hard twisted polyester filament yarn, which is capable of widening a range of acceptable temperature in heat treatment for imparting properties to a polyester filament yarn, which comprise a boil-off shrinkage in boiling water being in a range between 0 to 5%, a thermal shrinkage stress at 140° C. of hot air being more than 0.03 g/de, and a ratio of a thermal shrinkage stress at 180° C. of hot air to a thermal shrinkage stress at 140° C. of hot air being more than 1.0.

These and other objects, features and advantages of the present invention will become more apparent upon a reading of the following detailed specification.

DETAILED DESCRIPTION OF THE INVENTION

It is quite required that a torque of a hard twisted yarn, which is temporarily set, revive fully to the previous state so as to obtain the excellent crepe developing on woven or knitted fabrics.

Generally, fabrics have a constrictive force between warp and weft yarns, which are caused by friction forces among these yarns. In case of a fabric having too strong constrictive force, a torque of a hard twisted yarn can not be revived effectively to develop the excellent crepe on the fabric. In other words, it is necessary to reduce above-mentioned constrictive force as low as possible, so that a torque of a hard twisted yarn can be exerted to develop the excellent crepe. The constrictive force existing in a fabric as mentioned above is in proportion to the boil off shrinkage of filament yarn in boiling water, because the apparent density of fabric, which is in proportion to the constrictive force, is proportionally increased with the boil off shrinkage of filament yarn. Therefore, it is required that the boil off shrinkage of filament yarn in boiling water should be limited to be in the range of 0% to 5% on account of developing the excellent crepe.

In addition to above-mentioned boil-off shrinkage, it is discovered by the inventors of the present invention that the power of the torque reviving in the woven or knitted fabric depends on a thermal shrinkage stress of a filament yarn at the heat treatment which is carried out at a high temperature to develop crepe.

In previous methods, a polyester filament yarn has generally a property concerning a thermal shrinkage stress, which has only one peak at a temperature approximately from 120° C. to 140° C. of hot air and becomes remarkably lower at a temperature above 140° C. Namely, a thermal shrinkage stress at 180° C. of hot air, recognizing as a temperature of crepe developing and equivalent to 100° C.-130° C. of superheated steam, is so low that the power of torque reviving is very weak and the effect of crepe developing is decreased.

Accordingly, in order to revive powerfully a torque of a hard twisted polyester filament yarn in a high level, it is important that the value of a thermal shrinkage stress of a polyester filament yarn at 140° C. of hot air is more than 0.03 grams per denier and a thermal shrinkage stress of a polyester filament yarn comes to have the maximum value at the temperature around 180° C. of hot air, which means that it is important that a ratio of a thermal shrinkage stress at 180° C. of hot air to a thermal shrinkage stress at 140° C. of hot air is more than 1.0.

A micro-structure of amorphous portion of a polyester filament yarn is generally considered as a characteristic concerned to a thermal shrinkage stress and it may be concluded that a thermal shrinkage stress can be maintained in high level in case of the state of an extensive micro-structure of amorphous portion and simultaneously a high density of amorphous phase.

For example, a boil off shrinkage of polyester filament in boiling water, which is produced in the high speed of spinning (4,000 to 5,000 meters per minute), can be ranged below 1%, but an excellent crepe can not be obtained on a fabric, which is manufactured with its polyester filament and soaked in hot water. It is considered as a main reason of the above phenomenon that a thermal shrinkage stress of a polyester filament yarn at 140° C. of hot air can not reach 0.03 grams per denier, due to a rather loose molecular structure of its amorphous portion.

Therefore, the following are finally required as the properties of a polyester filament yarn for the present invention;

(a) a boil off shrinkage in boiling water being in a range of 0% to 5%.
(b) a thermal shrinkage stress at 140° C. of hot air being more than 0.03 g/de.
(c) a ratio of a thermal shrinkage stress at 180° C. of hot air to a thermal shrinkage stress at 140° C. of hot air being more than 1.0.

If the properties of a polyester filament yarn are selected according to the above mentioned conditions, the excellent crepe can be developed on a fabric, without a high specific gravity, which means that a high specific gravity is not the indispensable condition for developing the excellent crepe, though it is disclosed as the indispensable condition in Japanese Patent Publication No. 23619/1976.

The following disclose different methods of producing a polyester filament yarn having such properties as above mentioned: after drawing a polyester filament yarn produced by the usual manner, different ways of heat treatments are executed;

(a) one method is to set above mentioned polyester filament yarn by a roller heated at a temperature from 160° C. to 220° C., maintaining its polyester filament yarn in the constant length according to a predetermined value.
(b) another method is to repeat the heat treatment several times, wherein above mentioned polyester filament is subjected to heat at a temperature from 160° C. to 220° C. in dry state, stretching its polyester filament yarn in the range of 2% to 10% and successively shrinking it in the same range.
(c) still another method is to heat treat above mentioned polyester filament yarn at a temperature from 160° C. to 220° C. in dry state, and shrinking restrictively its polyester filament yarn in the range of 0% to 10% under the relaxed state.

A polyester filament yarn having the required properties according to one of above mentioned methods is given a hard twist, the number of which is generally selected in the range of 2,000 to 4,000 turns per meter, depending on the quality of required fabric (the desirable degree of crepe and hand) and the denier of filament.

It is preferably adopted that a polyester filament yarn in the present invention is previously forwarded to a sizing process before a hard twist is given, the adoption of which may be decided according to the desirable degree of crepe on a fabric, especially in case of deep and large crepe required.

In the above-mentioned sizing process, sizing compositions including a starch component, a polyvinyl alcohol component, an acrylic component and etc. are preferably used.

A hard twisted polyester filament yarn obtained in above mentioned method is forwarded to a process of heat treatment, wherein a torque of hard twisted polyester filament yarn enters into a latent state by setting it at a temperature from 70° C. to 130° C., preferably from 80° C. to 100° C. of saturated or superheated steam in a setting time from 10 minutes to 1 hours. Instead of saturated or superheated steam, it is also available to use heating means like hot air heated from 70° C. to 180° C., preferably from 80° C. to 130° C., in the above ranging temperature of which the same setting effect can be obtained as in a temperature of saturated or superheated steam from 70° C. to 130° C. Further, it may be necessary to take a prolonged setting time from 30 minutes to 2 hours.

An effect of adopting a sizing before giving a hard twist to a polyester filament yarn is to soften or melt sizing compositions bestowed and impregnated to a polyester filament yarn in setting a hard twist, so that an action of making a torque latent is emphasized during making a fabric, thus the latent torque can be rapidly revived on a fabric in a process of developing crepe.

A hard twisted polyester filament yarn obtained above mentioned process is used for warp and/or weft yarns of woven or knitted fabrics, which are required to develop crepe usually by soaking in hot water.

The present invention has the following advantages:

(a) it is possible to make a woven or knitted crepe fabric having uniform excellent crepe, which is developed only by soaking its fabric in hot water.
(b) it is possible to make a woven or knitted crepe fabric having a uniform width and a desirable heat shrinkage of fabric.
(c) it is possible to remove serious problems such as deteriorated dyeing ability, harsher hand and difficult processing laid in the conventional methods.
(d) it is possible to reduce a difference of setting effect between the inside and outside of yarn bobbins at setting a torque.

EXAMPLE 1

Polyethylene terephthalate chips having an instrinsic viscosity of 0.65 (which was measured in orthochlorophenol) were melted at 290° C. and extruded through a spinneret having 24 orifices in accordance with the usual manner, followed by winding up at the speed of 1500 m/min.

The polyester filament yarns obtained in above mentioned conditions were drawn at the draw-ratio of 3.0 between the feed roller of 80° C. and the draw roller of 180° C., and further, these filament yarns were repeatedly, up to 8 times, subjected to the heat treatment, in which these filament yarn were stretched in 7% and successively shrunk in the same ratio by a step roller heated at 180° C., followed by winding up at the draw-speed of 330 m/min.

Thus, resulting polyester filament yarns of 50 denier/24 filaments were given such a hard twist as 3000 turns per meter (s-twist and z-twist) after sizing with a sizing composition including an acrylic component, and then hard twisted polyester filament yarns were subjected to saturated steam of 85° C. for 30 minutes so as to set temporarily a torque of hard twist.

Using hard twisted polyester filament yarns obtained in above-mentioned process, a plain fabric was woven in the density of 32 warps per inch and 37 wefts per inch, arranging alternately 2 filament yarns of s-twisted and z-twisted both in warp and weft, and finally a grey fabric was soaked and stirred in hot water of 100° C. for 20 minutes so as to develop crepe.

In respect of the resulting fabric, the ratio of a width of creped fabric, which was shrunk to develop crepe, to a width of grey fabric (defined as a shrinkage of fabric width) and the degree of crepe developed on a fabric were shown in table 1, wherein properties of filament yarns used in example 1 were also shown. Simultaneously, the corresponding data obtained in a comparable crepe fabric which was produced by a hard twisted polyester filament yarn (50 denier/24 filaments) made in a conventional manner, were also shown in table 1.

Table 1

| | Filament yarn of present invention | Filament yarn of conventional method |
|---|---|---|
| Boil off shrinkage in boiling water (%) | 2.1 | 7.3 |
| Thermal shrinkage stress at 140° C. (g/de) | 0.18 | 0.39 |
| Thermal shrinkage stress at 180° C. (g/de) | 0.20 | 0.32 |
| Specific gravity | 1.3868 | 1.3761 |
| Shrinkage of fabric width (%) | 62 | 12 |

Table 1-continued

| | Filament yarn of present invention | Filament yarn of conventional method |
|---|---|---|
| Density of crepe | high | low |
| Uniformity of crepe | excellent | fair |

EXAMPLE 2

Polyester filament yarns (50 denier/24 filaments) spun in the same manner as example 1 were drawn in the total draw-ratio of 3.05 between the feed roller heated at 80° C. and the step roller heated at 180° C., simultaneously being subjected to the heat treatment through a slit heater of 230° C., wherein these filament yarns were shrunk in 7% under the relaxed state, and successively being followed by winding up at the speed of 330 m/minute. Thus, resulting polyester filament yarns were twisted by 3000 turns per meter (S-twist), and then resulting hard twisted polyester filament yarns were subjected to saturated steam of 95° C. for 30 minutes so as to set temporarily a torque of hard twist.

Using polyester filament yarns obtained in the conventional manner as warp yarns and hard twisted polyester filament yarns obtained in above mentioned manner as weft yarn, a plain fabric was woven in the density of 62 ends per inch and 33 picks per inch.

And finally, a grey fabric woven as above was subjected to the treatment of developing crepe in hot water of 100° C. for 30 minutes.

The resulting fabric, Yoryu crepe fabric, had the excellent crepe, without such problems as non-uniformly developed crepe and irregular width of fabric.

EXAMPLE 3

Hard twisted polyester filament yarns of 50 denier/24 filaments obtained in the same manner as in example 1 were subjected to heat at 95° C. in dry state for 60 minutes so as to set temporarily a torque of hard twist.

Using hard twisted polyester filament yarns obtained in above conditions of setting twist, a plain fabric was made in the same manner as in example 1. The resulting fabric had the uniform excellent crepe and width of fabric.

The data concerning the resulting fabric as well as a comparable crepe fabric were shown in table 2.

Table 2

| | Filament yarn of present invention | Filament yarn of conventional method |
|---|---|---|
| Boil off shrinkage in boiling water (%) | 2.1 | 7.3 |
| Thermal shrinkage stress at 140° C. (g/de) | 0.18 | 0.39 |
| Thermal shrinkage stress at 180° C. (g/de) | 0.20 | 0.32 |
| Specific gravity | 1.3868 | 1.3761 |
| Shrinkage of fabric width (%) | 71.2% | 14.3% |
| Density of crepe | high | low |
| Uniformity of crepe | excellent | fair |

It is well known that the shrinkage of fabric width is one of representative parameters of the crepe quality and when the shrinkage of fabric width is increased, the depth and density of crepe are increased.

What we claim is:

1. A method of producing a polyester filament yarn having a high level of twist which comprises imparting a high level of twist to a polyester filament yarn and subjecting said twisted yarn to a heat treatment in a hot fluid at a temperature from 70° C. to 130° C. to set the twisted yarn; said polyester filament yarn having the following properties:

(a) a boil-off shrinkage in boiling water being in a range of 0% to 5%

(b) a thermal shrinkage stress at 140° C. in hot air being more than 0.03 g/de (c) a ratio of a thermal shrinkage stress at 180° C. in hot air to a thermal shrinkage stress at 140° C. in hot air being more than 1.0.

2. A method according to claim 1, wherein said heat treatment is carried out in hot air at a temperature ranging from 70° C. to 180° C.

3. A method according to claim 1, wherein said polyester filament yarn is imparted a twist between 2000 and 4000 turns per meter.

4. A method according to claim 1, wherein said polyester filament yarn is obtained by heating said yarn at a temperature from 160° C. to 220° C. in a dry state, stretching said polyester filament yarn in a range of 2% to 10% shrinking said yarn in the same range and repeating said heating, stretching and shrinking steps several times.

5. A method according to claim 1, wherein said polyester filament yarn is obtained by being subjected to heat treatment at a temperature from 160° C. to 220° C. in a dry state, shrinking restrictively said polyester filament yarn in a range of 0% to 10% under a relaxed state.

* * * * *